US011377808B2

(12) United States Patent
Novarin et al.

(10) Patent No.: US 11,377,808 B2
(45) Date of Patent: Jul. 5, 2022

(54) ANCHOR DEVICE FOR PRESTRESSED DIAPHRAGM WALL

(71) Applicant: SOLETANCHE FREYSSINET, Rueil Malmaison (FR)

(72) Inventors: Marco Novarin, Le Perreux sur Marne (FR); Bertrand Steff De Verninac, Les Alluets-le-Roi (FR); Thierry Jeanmaire, Houilles (FR); Nicolas Demey, Asnieres sur Seine (FR)

(73) Assignee: SOLETANCHE FREYSSINET, Rueil Malmaison (FR)

( * ) Notice: Subject to any disclaimer, the term of this patent is extended or adjusted under 35 U.S.C. 154(b) by 0 days.

(21) Appl. No.: 16/481,955

(22) PCT Filed: Feb. 13, 2018

(86) PCT No.: PCT/FR2018/050337
§ 371 (c)(1),
(2) Date: Jul. 30, 2019

(87) PCT Pub. No.: WO2018/146431
PCT Pub. Date: Aug. 16, 2018

(65) Prior Publication Data

US 2020/0040543 A1 Feb. 6, 2020

(30) Foreign Application Priority Data

Feb. 13, 2017 (FR) ..... 1751164

(51) Int. Cl.
*E02D 5/74* (2006.01)
*E02D 5/18* (2006.01)
*E04C 5/12* (2006.01)

(52) U.S. Cl.
CPC ..... *E02D 5/74* (2013.01); *E02D 5/18* (2013.01); *E04C 5/12* (2013.01)

(58) Field of Classification Search
CPC ..... E02D 5/80; E02D 5/54; E04C 5/12
(Continued)

(56) References Cited

U.S. PATENT DOCUMENTS 4,069,677 A * 1/1978 Yamada ..... E02D 5/74 405/259.5
4,934,118 A * 6/1990 Miebeler ..... E04C 5/085 52/223.13

(Continued)

FOREIGN PATENT DOCUMENTS

| | | |
|---|---|---|
| AT | 397 522 B | 4/1994 |
| GB | 2 120 304 A | 11/1983 |
| WO | 2014/135768 A1 | 9/2014 |

OTHER PUBLICATIONS https://www.thefreedictionary.com/outside.*

*Primary Examiner* — Sean D Andrish
(74) *Attorney, Agent, or Firm* — Dentons US LLP

(57) ABSTRACT

The invention relates to an anchor device for a prestressed diaphragm wall, comprising at least one prestressing reinforcement and a sleeve encasing said at least one prestressing reinforcement and forming an anchorage for said at least one prestressing reinforcement in the diaphragm wall, a length (Ld) of the anchor sleeve being strictly less than a length (La) of said at least one prestressing reinforcement, the anchor sleeve comprising a sealing material disposed in such a way as to coat each prestressing reinforcement, the anchor device comprising a corrosion-resistant coating of each prestressing reinforcement.

18 Claims, 5 Drawing Sheets

(58) Field of Classification Search
USPC ..... 405/259.1
See application file for complete search history.

(56) References Cited

U.S. PATENT DOCUMENTS

| | | | | |
|---|---|---|---|---|
| 5,079,879 | A * | 1/1992 | Rodriguez | E04C 5/12<br>24/122.6 |
| 2003/0015038 | A1* | 1/2003 | Rodger | G01N 29/46<br>73/649 |
| 2016/0010302 | A1* | 1/2016 | Mellier | E02D 17/13<br>405/287 |

* cited by examiner

ANCHOR DEVICE FOR PRESTRESSED DIAPHRAGM WALL

This application is a National Stage Application of International Application No. PCT/FR2018/050337, filed on Feb. 13, 2018, and claims the benefit of French Patent Application No. 17 51164, filed on Feb. 13, 2017, all of which are hereby incorporated by reference in their entirety for all purposes as if fully set forth herein.

The invention relates to an anchor device for a prestressed diaphragm wall.

Such a diaphragm wall is a reinforced concrete structure to which prestressing tendons are added. It is generally obtained by excavating a required volume of the ground (earth or rock), the dimensions whereof are chosen as a function of the desired capacities of the diaphragm wall.

The route of each prestressing tendon can have variations in eccentricity in the thickness of the diaphragm wall, according to a determined profile in the design note for the construction project.

During the excavation, the ground is prevented from caving-in thanks to the placement of a drilling mud (for example a bentonite mud), with which the borehole is gradually filled while maintaining a substantially constant level.

Then, a reinforcement cage intended to reinforce the concrete of the diaphragm wall is lowered into the excavated volume and filled with mud.

Metal ducts forming prestressing channels are inserted into the reinforcement cage.

Prestressing tendons are then threaded through the ducts and anchored in the lower parts thereof.

In the excavation, in which the reinforcement cage and the prestressing tendons are located, concrete is poured by means of a tremie, starting from the bottom of the wall.

This concrete gradually replaces the drilling mud which is simultaneously pumped.

The diaphragm wall is formed when the concrete has set and reached a mechanical strength that is considered sufficient.

The tendons can then be tensioned from the anchorages installed in the top part, so as to prestress the diaphragm wall.

The production of the diaphragm wall is completed by the injection of a cement grout into the ducts receiving the prestressing tendons.

Such a prestressing of the diaphragm wall allows the thickness thereof to be reduced for the same strength (compared to a diaphragm wall without prestressing tendons).

Nonetheless, the method of manufacture described hereinabove is complex to carry out, since it requires the placement of the ducts forming prestressing channels, the prestressing tendons, the anchoring of these tendons and the injection of cement grout into the prestressing ducts.

Another drawback concerns the uncertain quality of the anchorage, connected to the possible heterogeneities in the concrete which can comprise localised defects such as water, drilling mud or soil inclusions.

Moreover, the prestressing tendons are subjected to external attacks, in particular corrosion, and local corrosion of the tendons is not uncommon before the placement and full hardening of the concrete and grouting, this corrosion significantly affecting the capacity and safety of the wall.

The purpose of the invention is to at least partially overcome these drawbacks.

For this purpose, the invention relates to an anchor device for a prestressed diaphragm wall, comprising at least one prestressing reinforcement and a sleeve encasing said at least one prestressing reinforcement and forming an anchorage for said at least one prestressing reinforcement in the diaphragm wall, a length of the anchor sleeve being strictly less than a length of said at least one prestressing reinforcement, the anchor sleeve comprising a sealing material disposed in such a way as to coat each prestressing reinforcement, the anchor device comprising a corrosion-resistant coating of each prestressing reinforcement (3) over the entire length of the prestressing reinforcement, the method of manufacturing the prestressed diaphragm wall being simplified, since the anchor device is prefabricated.

Thus, thanks to the anchor device according to the present invention, the method of manufacturing the diaphragm wall is simplified, since the anchor device is prefabricated.

The anchor device according to the present invention further allows an anchorage and an effective tensioning of each prestressing reinforcement to be produced.

Moreover, each prestressing reinforcement is protected from corrosion, including during the manufacture of the diaphragm wall.

According to another feature of the invention, the corrosion-resistant coating comprises a duct for protecting the prestressing reinforcement in a part of the prestressing reinforcement disposed outside of the sleeve.

According to another feature of the invention, the corrosion-resistant coating comprises a material for coating the prestressing reinforcement in a part of the prestressing reinforcement disposed outside of the sleeve.

According to another feature of the invention, the corrosion-resistant coating of the sealing part comprises the sealing material disposed in contact with the prestressing reinforcement in the sleeve.

According to another feature of the invention, the sleeve comprises an outer surface provided with rough areas.

According to another feature of the invention, the rough areas are formed by ringed ridges and/or ribs.

According to another feature of the invention, the device comprises a duct encapsulating a sheath of the anchor sleeve.

According to another feature of the invention, said at least one prestressing reinforcement comprises a plurality of wires spread out and bent back on themselves in the anchor sleeve.

According to another feature of the invention, the sealing material is a mortar, for example of the ultra-high performance fibre-reinforced type or a cement grout.

According to another feature of the invention, the length of the anchor sleeve lies in the range 2% to 50% of the length of the prestressing reinforcement, preferably in the range 2% to 20%.

According to another feature of the invention, the device comprises a sealed plug in an overlap zone between a part of said at least one prestressing reinforcement in the anchor sleeve and a part of said at least one prestressing reinforcement outside of the anchor sleeve.

The invention further relates to a prestressed diaphragm wall comprising at least one anchor device as described hereinabove, wherein the anchor sleeve is sealed at a portion of the diaphragm wall.

The invention further relates to a method of manufacturing a diaphragm wall, comprising:

- a step of excavating in the ground,
- a step of inserting, into the excavation, a reinforcement cage provided with at least one anchor device as described hereinabove, a step of pouring concrete into the excavation provided with the reinforcement cage and with said at least one anchor device, a step of tensioning each prestressing reinforcement of said at least one anchor device.

Other features and advantages of the invention will appear upon reading the following description, which is given for illustrative purposes only and must be read with reference to the accompanying drawings, in which.

Anchor Device

Figure 1:
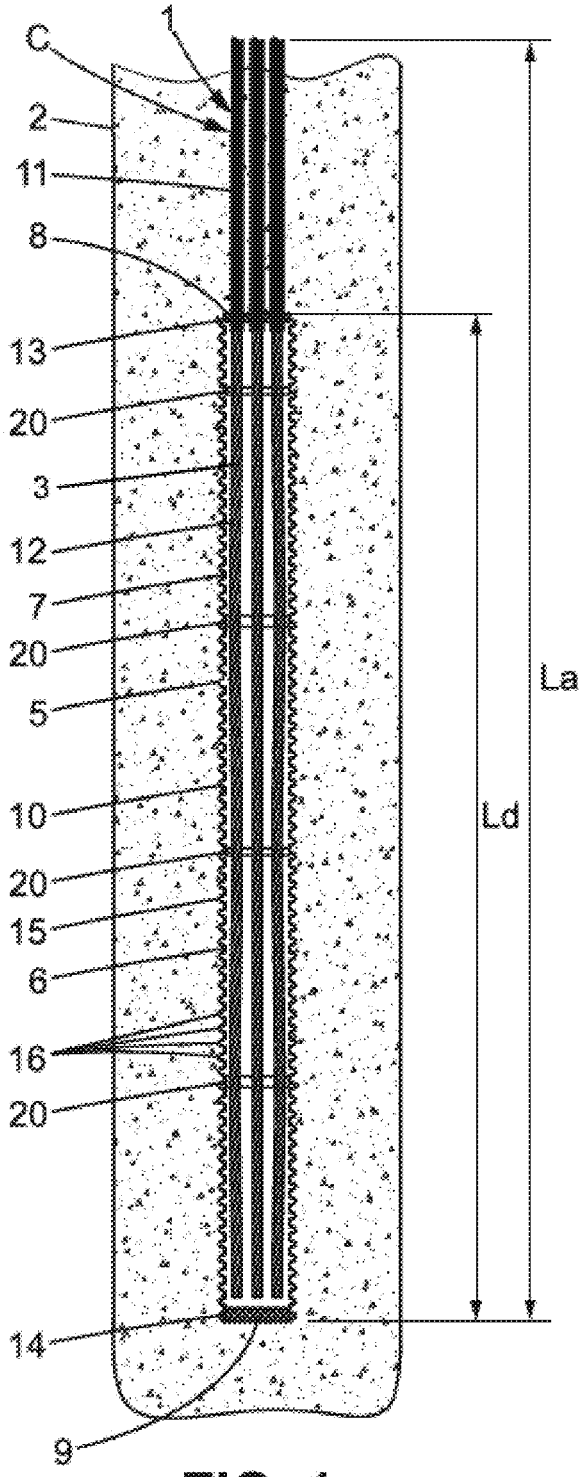
FIG. 1 shows a longitudinal sectional view of a prestressed diaphragm wall according to a first embodiment of the invention.
Figure 1A:
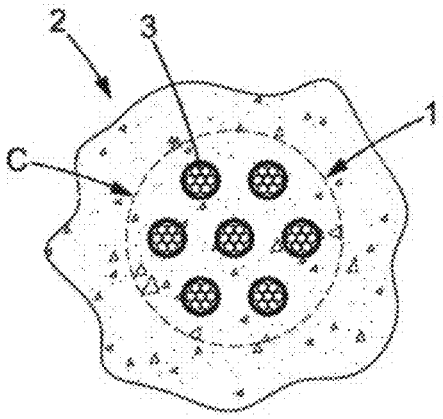
FIGS. 1A and 1B show cross-sectional views of a prestressing tendon outside the anchor sleeve thereof and inside the anchor sleeve thereof respectively.
Figure 1B:
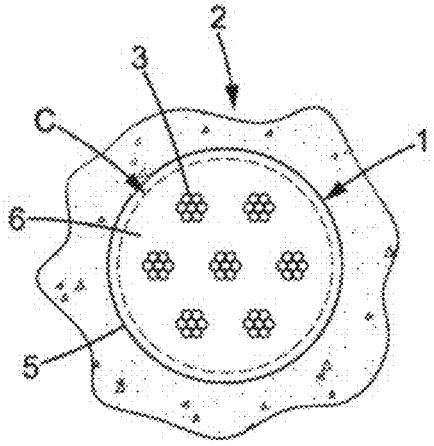

The invention relates to an anchor device for a prestressed diaphragm wall.

The anchor device is denoted by the reference numeral 1 in the figures, whereas the prestressed diaphragm wall is denoted by the reference numeral 2.

The anchor device 1 will now be described in detail according to three embodiments.

The anchor device 1 comprises at least one prestressing reinforcement 3.

In the embodiments shown, the anchor device 1 comprises a plurality of prestressing reinforcements 3.

Advantageously, the one or more prestressing reinforcements 3 form part of a tendon.

Figure 2:
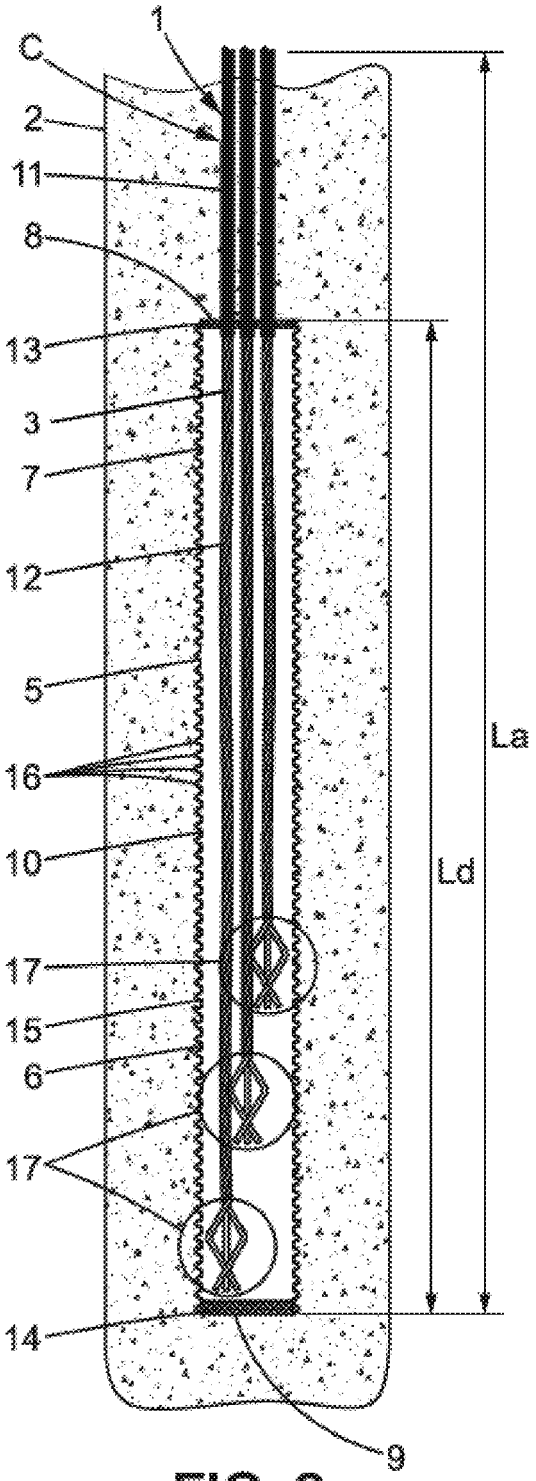
FIG. 2 shows a longitudinal sectional view of a prestressed diaphragm wall according to a second embodiment of the invention.
Figure 3:
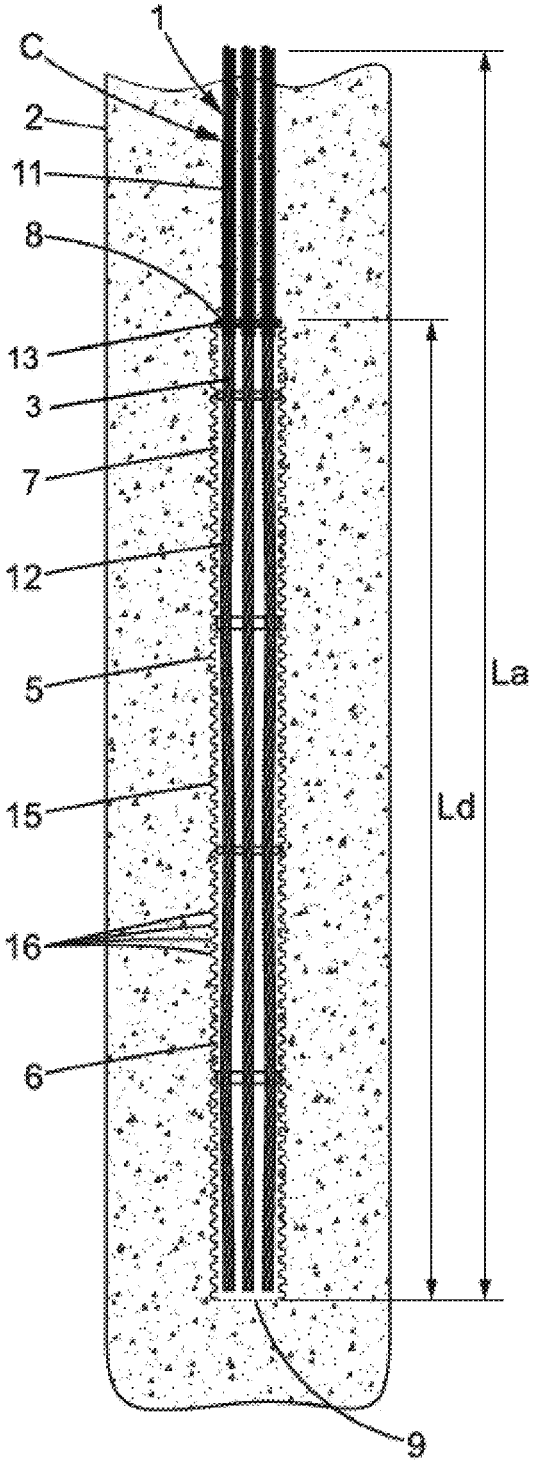
FIG. 3 shows a longitudinal sectional view of a prestressed diaphragm wall according to a third embodiment of the invention.

Thus, in FIGS. 1 to 3, a tendon C is shown, comprising three prestressing reinforcements 3, seven reinforcements in the cross-sectional views 1A and 1B.

More generally, the tendon C comprises at least one prestressing reinforcement 3, and the diaphragm wall 2 can comprise a plurality of tendons C including at least one prestressing reinforcement each.

The prestressing reinforcements 3 are, for example, strands.

Each prestressing reinforcement 3 comprises a corrosion-resistant coating 4, described in detail hereafter, over the entire length thereof.

The anchor device 1 further comprises a sleeve 5 encasing the prestressing reinforcements 3.

The sleeve 5 forms an anchorage for the prestressing reinforcements 3 in the diaphragm wall 2.

As shown in FIGS. 1 to 3, the sleeve 5 comprises a sealing material in order to coat each prestressing reinforcement 3.

In the embodiments shown, the prestressing reinforcements have the same length, denoted La.

It goes without saying that the invention is not limited to the embodiments shown, and that the reinforcements can have lengths La that are different to one another.

The sleeve 5 has a length denoted Ld.

As shown in FIGS. 1 to 3, the length Ld of the anchor sleeve 5 is strictly less than the length La of the prestressing reinforcements 3.

In the case where the prestressing reinforcements have different lengths, the length Ld of the anchor sleeve 5 is strictly less than the smallest length of the prestressing reinforcements 3, which ensures that each prestressing reinforcement 3 can effectively be tensioned in order to prestress the diaphragm wall.

Advantageously, the length of the sleeve lies in the range 2% to 50% of the length of the reinforcement.

Preferably, the length of the sleeve lies in the range 2% to 20% of the length of the reinforcement.

These value ranges ensure both a good anchorage of the sleeve 5 in the diaphragm wall 2 and a good straining of each prestressing reinforcement 3 for improved durability of the prestressing forces.

Each prestressing reinforcement 3 has a slenderness that lies in the range 10 to 30, for example equal to about 20.

The term 'slenderness' is understood to be a ratio between the length and diameter of the sleeve.

Given that the sleeve according to the invention is slender, the prestressing reinforcement 3 can be adapted to suit numerous diaphragm wall configurations, including bulky reinforcement cages.

According to another feature, each prestressing reinforcement 3 comprises a corrosion-resistant coating.

The sleeve 5 comprises a sheath 6 formed from the sealing material.

The sheath 6 has an overall cylindrical shape.

The sheath 6 comprises a curved side wall 7 and two opposite bases 8, 9.

The base 9 forms the bottom of the sheath 6.

In the embodiments in FIGS. 1 and 2, the sleeve 5 further comprises a duct 10 for encapsulating the sheath 6.

According to these embodiments, the encapsulating duct 10 forms the anchorage of the anchor device 1.

In the embodiment in FIG. 3, the sleeve is devoid of any encapsulating duct 10.

According to this embodiment, the sheath 6 contributes to the anchorage of the anchor device 1.

The encapsulating duct 10 has substantially the same length as the sheath 6.

As shown in FIGS. 1 to 3, each prestressing reinforcement 3 is partially threaded through the sleeve 5.

Each reinforcement comprises a first part 11, otherwise referred to as a standard part, and a second part 12, otherwise referred to as a sealing part.

Figure 1C:
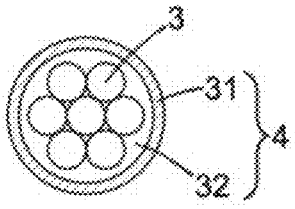
FIG. 1C is a detailed view of a section of a prestressing reinforcement in a so-called standard part.

As shown in FIG. 1C, in the standard part 11 of the prestressing reinforcement 3, the anchor device 1 comprises an individual protective duct 31 for each prestressing reinforcement 3 and/or a coating material 32 for each prestressing reinforcement 3.

The term 'coating material' is understood to be a material that has a sufficiently low shear strength to leave the prestressing reinforcement 3 free to slide.

In other words, the coating material is flexible, insofar as the shear force can be considered to be negligible relative to the force developed by the prestressing reinforcement during the tensioning thereof.

The coating material is in the solid state, in that it does not run, such that the coating is stable.

The coating material is, for example, pasty or semi-pasty.

The coating material contributes to protecting the prestressing reinforcement from corrosion.

This is, for example, a grease or a wax.

The protective duct is, for example, made with a high density polyethylene (HDPE) base.

In the sealing part 12, each prestressing reinforcement 3 is bare, i.e. comprises neither a coating material nor a protective duct.

The sealing part 12 is disposed entirely within the sleeve 5.

The standard part 11 is mainly disposed outside of the sleeve 5.

The standard part optionally penetrates the sleeve over a short length, for example equal to about 5 cm to 10 cm.

In other words, the first base 8 of the sleeve 5 can be considered to form an interface between the standard part 11 and the sealing part 12 of the prestressing reinforcements 3.

As stated hereinabove, each prestressing reinforcement 3 comprises a corrosion-resistant coating.

For each prestressing reinforcement 3, the corrosion-resistant coating of the standard part 11 comprises the protective duct 31 and/or the coating material 32.

For each prestressing reinforcement 3, the corrosion-resistant coating of the sealing part 12 comprises the sealing material disposed in direct contact with the prestressing reinforcement 3.

According to another feature, the anchor device 1 comprises at least one impervious plug in order to procure the impermeability of the anchor sleeve 5.

The impervious plug is preferably positioned on the base 8 of the sleeve 5 forming an interface between the standard part 11 and the sealing part 12 of the prestressing reinforcements 3.

In the embodiments shown in FIGS. 1 and 2, the anchor device comprises a first plug and a second plug.

The first plug 13 is positioned on the base 8.

The second plug 14 is positioned beneath the second base 9.

The plugs are advantageously made with an elastomer material base.

As shown in FIGS. 1 to 3, the sleeve 5 comprises an outer surface 15 provided with rough areas 16.

The outer surface 15 is that of the encapsulating duct 10 (for FIGS. 1 and 2) or that of the sheath 6 (for FIG. 3).

The rough areas 16 form adhesions providing for a better anchorage of the anchor device 1 in the diaphragm wall 2.

The rough areas 16 are, for example, formed by ringed ridges (rings) and/or ribs.

In the embodiments shown in FIGS. 1 and 3, each of the prestressing reinforcements 3 comprises a plurality of wires.

For example, the reinforcement can be a seven-wire strand, contiguously bundled with a core wire following the mean route (rectilinear route) and six peripheral helical wires.

In the embodiment shown in FIG. 2, each of the prestressing reinforcements 3 comprises a plurality of wires that are spread out and bent back on themselves in the anchor sleeve, in bending zones denoted by the reference numeral 17.

According to another feature, the sealing material of the sleeve 5 is a mortar, for example of the ultra-high performance fibre-reinforced concrete type (known under the acronym UHPFRC) or a cement grout.

It should be noted that the use of the cement grout is advantageous with the wires spread out and bent back on themselves since this wire configuration procures good anchoring that does not require the use of a particularly high-performance sealing material.

When cement grout is used, the encapsulating duct provides good confinement and good shrink-fitting of the sleeve.

The use of mortar of the ultra-high performance concrete type is advantageous since it enables the sealing of reinforcements whose route is rectilinear or slightly rippled.

The use of this ultra-high performance concrete type mortar, which provides a high tensile strength, is advantageous for preventing the need to use a duct 10 for encapsulating the sleeve, according to the embodiment in FIG. 3.

Figure 4:
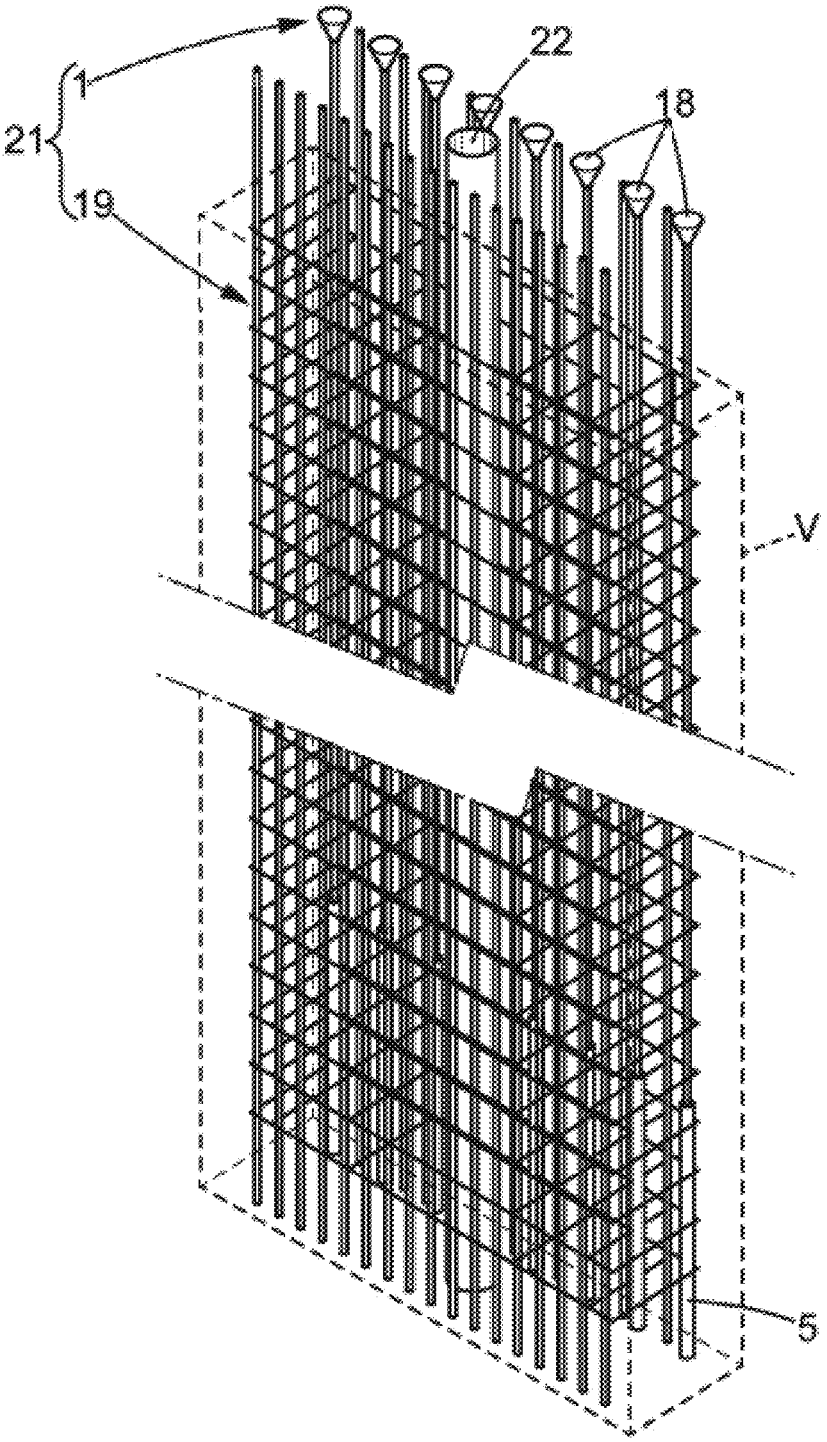
FIG. 4 shows a perspective view of a reinforcement cage provided with an anchor device according to the present invention.

The anchor device 1 further comprises an anchor head 18 or active anchorage 18 for each tendon and/or prestressing reinforcement 3, via which each reinforcement is tensioned, as shown in FIG. 4.

The anchor device 1 further comprises one or more spacers 20 for spacing the prestressing reinforcements 3.

The spacer 20 allows the prestressing reinforcements 3 to be spaced apart from one another in order to ensure that they are immersed in the sealing material and that the route has ripples.

According to an alternative embodiment, not shown, each prestressing reinforcement 3 is provided with a sleeving, the lower end whereof is crimped, embedded in the sealing part.

Each crimped sleeving is advantageously made with a ductile, plastically deformed, forged steel base on the end of the reinforcement.

The crimped sleevings procure a good anchorage of the prestressing reinforcement in the sheath.

As already shown in the description, each anchor device advantageously corresponds to a tendon.

Each tendon comprises at least one prestressing reinforcement, and often a plurality of prestressing reinforcements.

A sleeve and an anchor head correspond to each tendon.

As has also been shown in the description hereinabove, the corrosion-resistant coating 4 comprises the sealing material of the sheath 6, in the sealing part 12 and the duct 31 and/or the coating material 32 in the standard part 11.

Diaphragm Wall

The invention further relates to the diaphragm wall 2 comprising at least one anchor device 1.

As shown in FIG. 4, the diaphragm wall further comprises a reinforcement cage 19.

The reinforcement cage 19 is passive, i.e. it is solicited proportionally to the actions to which the diaphragm wall 2 is subjected.

As shown in FIG. 4, the anchor devices 1 are disposed in the reinforcement cage, preferably held in position in the reinforcement cage.

The assembly formed by the reinforcement cage and the anchor devices is denoted by the reference numeral 21.

The assembly 21 is disposed in a volume V.

The volume V is filled by the assembly 21 and by a resistant material, such as concrete.

The invention further relates to a method of manufacturing a diaphragm wall, comprising:

- a step of excavating the volume V of ground (earth or rock), the dimensions whereof are chosen as a function of the desired capacities of the diaphragm wall 2, this volume V being filled with a drilling mud intended to maintain the vertical walls of the excavation while allowing for the gradual replacement thereof when pouring the concrete,
- a step of inserting, into the excavation, the assembly 21 formed by the reinforcement cage 19 and the anchor devices 1,
- a step of concreting the volume V wherein the assembly 21 is located, the drilling mud being simultaneously pumped, a step of tensioning each prestressing reinforcement of each anchor device 1 from the anchor head, at the upper end of the anchor device, and a step of encasing the active anchor of each of the anchor devices 1 in order to complete the mechanical and corrosion-resistant protection of these tendons, since the head is the only exposed part of the anchor device.

Preferably, during the excavation step, the volume V is kept filled with drilling mud at a constant level using a drilling mud, for example a bentonite-type mud, in order to prevent the vertical walls of the ground from caving in and to maintain a volume V of the desired dimensions.

During the concreting step, in the excavation wherein the reinforcement cage 19 and the anchor devices 1 are located, concrete is poured via a tremie 22, which concrete gradually replaces the drilling mud, the drilling mud itself being simultaneously pumped.

The diaphragm wall 2 is formed when the concrete has set and reached a mechanical strength that is considered sufficient.

Each prestressing reinforcement 3 can then be tensioned so as to prestress the diaphragm wall.

As shown by the method of manufacturing the prestressed diaphragm wall, the anchor devices 1 are manufactured in full before the prestressed diaphragm wall 2, which significantly simplifies the method of manufacturing the prestressed diaphragm wall compared to the prior art.

The prior manufacture of the anchor devices 1 allows the quality of sealing of each prestressing reinforcement 3 to the sleeve 5 to be controlled, which cannot be equalled in the case of the injection of sealing material during the manufacture of the diaphragm wall 2.

It should also be noted that the corrosion-resistant treatment of each prestressing reinforcement 3 of each anchor device 1 prevents the devices 1 from becoming corroded during the manufacture of the prestressed diaphragm wall 2, even if the construction duration of the diaphragm wall lasts several weeks.

It should also be noted that, unlike for the prior art, each anchor device 1 is devoid of any duct forming a channel for the prestressing tendons in the reinforcement cage (of the reinforced concrete).

Conversely, according to the specific structure of the prestressing reinforcements 3, each reinforcement 3 slides in an individual duct 31 which is associated therewith and/or thanks to the coating material 32, which allows each reinforcement to be individually tensioned, which is not always possible when using a collective channel according to the prior art.

It should also be noted that, unlike for the prior art, no injection of cement grout into the duct forming the channel is required, the latter being made pointless and each prestressing reinforcement being individually protected from corrosion by the individual duct 31 thereof and/or by the coating material 32 thereof in the standard part on the one hand, and on the other hand by the sealing material of the sleeve in the sealing part.

The invention claimed is:

1. An anchor device for a prestressed diaphragm wall, comprising at least one prestressing reinforcement and a sleeve encasing said at least one prestressing reinforcement and forming an anchorage for said at least one prestressing reinforcement in the diaphragm wall, a length (Ld) of the anchor sleeve being strictly less than a length (La) of said at least one prestressing reinforcement, the anchor sleeve comprising a sealing material disposed in such a way as to coat each prestressing reinforcement, the anchor device comprising a corrosion-resistant coating of each prestressing reinforcement over all the length of each prestressing reinforcement, the anchor device further comprising a first sealed plug in an overlap zone between a part of said at least one prestressing reinforcement in the anchor sleeve and a part of said at least one prestressing reinforcement above the anchor sleeve, wherein each prestressing reinforcement comprises an individual protecting duct provided around the part of each prestressing reinforcement above the anchor sleeve, and wherein the anchor device further comprises a second sealed plug positioned beneath a first base forming a bottom of the sleeve, wherein the corrosion-resistant coating comprises the individual protecting duct, said individual protecting duct protecting individually each prestressing reinforcement only in the part of each prestressing reinforcement disposed above the sleeve.

2. The anchor device according to claim 1, wherein the corrosion-resistant coating comprises the sealing material disposed in contact with the at least one prestressing reinforcement in the sleeve in a part of the at least one prestressing reinforcement disposed within the sleeve.

3. The anchor device according to claim 1, wherein the sleeve comprises an outer surface provided with rough areas.

4. The anchor device according to claim 1, wherein the sleeve comprises an outer surface provided with rough areas, the rough areas being formed by at least one of ringed ridges and ribs.

5. The anchor device according to claim 1, comprising a duct for encapsulating a sheath of the anchor sleeve.

6. The anchor device according to claim 1, wherein said at least one prestressing reinforcement comprises a plurality of wires spread out and bent back in the anchor sleeve.

7. The anchor device according to claim 1, wherein the sealing material is a mortar.

8. The anchor device according to claim 1, wherein the length (Ld) of the anchor sleeve lies in the range 2% to 50% of the length (La) of said at least one prestressing reinforcement.

9. The anchor device according to claim 8, wherein the length (Ld) of the anchor sleeve lies in the range 2% to 20% of the length (La) of said at least one prestressing reinforcement.

10. A prestressed diaphragm wall comprising at least one anchor device according to claim 1, wherein the anchor sleeve is sealed in a portion of the diaphragm wall.

11. A method of manufacturing a diaphragm wall, comprising:

a step of excavating in the ground, a step of inserting, into the excavation, a reinforcement cage provided with at least one anchor device according to claim 1, a step of pouring concrete into the excavation provided with the reinforcement cage and with said at least one anchor device, and a step of tensioning each prestressing reinforcement of said at least one anchor device.

12. The method according to claim 11, wherein the at least one anchor device is manufactured in full before the manufacturing of the diaphragm wall.

13. The anchor device according to claim 1, wherein the sealing material is an ultra-high performance fiber-reinforced concrete type or a cement grout.

14. The anchor device according to claim 1, wherein each prestressing reinforcement has a slenderness that lies in the range 10 to 30.

15. The anchor device according to claim 14, wherein each prestressing reinforcement has a slenderness of about 20.

16. The anchor device according to claim 1, wherein the first plug is positioned on a second base forming an interface between the part of said at least one prestressing reinforcement in the anchor sleeve and the part of said at least one prestressing reinforcement above the anchor sleeve.

17. The anchor device according to claim 1, wherein the corrosion-resistant coating further comprises a material for coating the at least one prestressing reinforcement in a part of the at least one prestressing reinforcement disposed above the sleeve.

18. The anchor device according to claim 17, wherein the coating material has a shear strength negligible relative to a force developed by each prestressing reinforcement during a tensioning of said prestressing reinforcement.

* * * * *